US012507751B2

(12) United States Patent
Ponich et al.

(10) Patent No.: US 12,507,751 B2
(45) Date of Patent: Dec. 30, 2025

(54) MEDICAL GOWN

(71) Applicant: PRIMED MEDICAL PRODUCTS INC., Edmonton (CA)

(72) Inventors: David Randall Ponich, Edmonton (CA); Joshua Alfred Eulert, Edmonton (CA); Enrico Wing Kei Fok, Edmonton (CA); Lucas Paul Ethier, Edmonton (CA)

(73) Assignee: PRIMED MEDICAL PRODUCTS INC., Edmonton (CA)

( * ) Notice: Subject to any disclaimer, the term of this patent is extended or adjusted under 35 U.S.C. 154(b) by 0 days.

(21) Appl. No.: 17/717,431

(22) Filed: Apr. 11, 2022

(65) Prior Publication Data

US 2022/0273057 A1 Sep. 1, 2022

Related U.S. Application Data

(63) Continuation-in-part of application No. 16/448,402, filed on Jun. 21, 2019, now abandoned.
(Continued)

(51) Int. Cl.
*A41D 13/12* (2006.01)

(52) U.S. Cl.
CPC ..... *A41D 13/129* (2013.01); *A41D 13/1209* (2013.01); *A41D 2400/44* (2013.01); *A41D 2400/52* (2013.01); *A41D 2500/30* (2013.01)

(58) Field of Classification Search
CPC ..... A41D 13/129; A41D 13/1209; A41D 2400/44; A41D 2400/52; A41D 2500/30
See application file for complete search history.

(56) References Cited

U.S. PATENT DOCUMENTS

D736,493 S 8/2015 Pasko
D741,044 S 10/2015 Pasko
(Continued)

OTHER PUBLICATIONS

Cardinal Health, Infection Control Apparel—Peace of Mind in All You Do, May 2019, pp. 1-24, USA.
(Continued)

*Primary Examiner* — Khaled Annis
(74) *Attorney, Agent, or Firm* — Field LLP

(57) ABSTRACT

The present disclosure provides a gown comprising a non-woven fabric having a front portion, a rear portion, a lower edge, and a head insertion aperture defined between the front portion and the rear portion; an opening, the opening defined in the rear portion, said opening formed at the lower edge and extending towards the head insertion aperture, configured to assist a wearer in donning the gown; and a bridge extending across the rear portion between the opening and head insertion aperture; the bridge serving to tear and split the rear portion when the front portion is pulled away by the wearer. The bridge is free from any aids to tearing and the bridge and the opening form the sole mechanisms for tearing the gown. A method of wearing and removing a gown is also provided. The method includes the steps of accessing the gown as described above; passing a head through the head insertion aperture to don the gown; and pulling the front portion, thereby tearing and splitting the between the head insertion aperture and the opening, to remove the gown. A method of making a gown is also provided.

7 Claims, 10 Drawing Sheets

Related U.S. Application Data

(60) Provisional application No. 62/694,821, filed on Jul. 6, 2018.

(56) References Cited

U.S. PATENT DOCUMENTS

| | | | | |
|---|---|---|---|---|
| D774,729 | S | 12/2016 | Pasko | |
| D779,155 | S | 2/2017 | Pasko et al. | |
| D779,156 | S | 2/2017 | Pasko | |
| D785,284 | S | 5/2017 | Pasko | |
| D787,780 | S | 5/2017 | Pasko et al. | |
| D791,434 | S | 7/2017 | Pasko | |
| D821,704 | S | 7/2018 | Pasko | |
| D836,297 | S | 12/2018 | Pasko | |
| D844,287 | S | 4/2019 | Pasko et al. | |
| 2011/0247122 | A1 | 10/2011 | Burke | |
| 2013/0091615 | A1 | 4/2013 | Pasko et al. | |
| 2013/0191960 | A1 | 8/2013 | Pasko | |
| 2013/0276203 | A1 | 10/2013 | Pasko et al. | |
| 2013/0276204 | A1 | 10/2013 | Pasko et al. | |
| 2013/0283496 | A1 | 10/2013 | Pasko et al. | |
| 2014/0007316 | A1* | 1/2014 | Tommarello | A41D 13/1236 2/114 |
| 2015/0208741 | A1 | 7/2015 | Pasko | |
| 2016/0066631 | A1 | 3/2016 | Pasko | |
| 2016/0220852 | A1 | 8/2016 | Samaniego | |
| 2018/0343940 | A1* | 12/2018 | Genender | A41D 13/1236 |

OTHER PUBLICATIONS

Medline Industries Inc., Know You're Covered. Personal Protective Apparel Head-to-Toe Protection for Healthcare, 2016, pp. 1-20, USA.

Halyard Health Inc., Protective Apparel Catalog, 2015, pp. 1-22, USA.

AMD Ritmed Inc., Tear-Away "Over-The-Head" Protective Isolation Gowns, Feb. 15, 2013, p. 1, Canada.

* cited by examiner

MEDICAL GOWN

FIELD OF DISCLOSURE

This disclosure relates generally to medical gowns and more specifically tear-off and disposable medical gowns.

BACKGROUND OF THE DISCLOSURE

Medical gowns are commonly used in hospitals, clinics, and other medical facilities, where they are worn by patients and staff at medical facilities. Medical gowns are used for their protective function to protect the wearer from contact with germs and other microscopic items and to limit the transmission of germs, bodily fluids and microscopic items in the medical facility. In addition, medical gowns can serve a privacy function when used by patients to cover their bodies during procedures which require the patient to disrobe.

One issue with the prior art medical gowns is that they can be difficult to remove. Users of hospital gowns often aim to remove the gown using minimum contact to the gown thereby reducing the spread of germs and other microscopic items between the medical gown and the user.

Another issue with the prior art medical gowns is that they require the user to raise the gown above the user's head during doffing which risks germs and other microscopic items coming into contact with the wearer or surroundings.

Some designs have used complicated and difficult to manufacture perforations and scores that serve as aids to tearing, to assist the wearing in removing the medical gown. Other designs have characteristics that are uncomfortable for some wearers.

For example, US Patent Application Publication Nos. US 2013/0276203 and US 2013/0191960 and U.S. Pat. No. 11,278,068 teach gowns that require perforations to be made in the gown to serve as an aid to tearing, to assist the wearer with removing the gown.

As another example, US Patent Application Publication No. US 2014/0007316 teaches a gown wherein the neckline includes a pointed or "v" in the rear side to aid in tearing of the gown. Such "V" neckline can be complicated to manufacture and less comfortable for the wearer, leaving a significant portion of the wearer's back exposed. It would be advantageous to have an improved gown that is easy to remove and simple to manufacture.

SUMMARY

The present disclosure provides a gown comprising a non-woven fabric having a front portion, a rear portion, a lower edge, and a head insertion aperture defined between the front portion and the rear portion; an opening, the opening defined in the rear portion, said opening formed at the lower edge and extending towards the head insertion aperture, configured to assist a wearer in donning the gown; and a bridge extending across the rear portion between the opening and head insertion aperture; the bridge serving to tear and split the rear portion when the front portion is pulled away by the wearer. The bridge is free from any aids to tearing and the bridge and the opening form the sole mechanisms for tearing the gown.

A method of wearing and removing a gown is also provided. The method includes the steps of accessing the gown as described above; passing a head through the head insertion aperture to don the gown; and pulling the front portion, thereby tearing and splitting the between the head insertion aperture and the opening, to remove the gown.

A method of making a gown is also provided. The method includes the steps of providing one or more lengths of non-woven fabrics each length having a top edge, a bottom edge, and two opposing side edges; layering the one or more lengths one on top of another to form a stack of lengths of nonwoven fabric; cutting into the stack a head insertion aperture approximately one-half distance between the top edge and the bottom edge and approximately one half distance between the two opposing side edges; cutting into the stack an opening parallel to the side edges, extending from the bottom edge to a point below the head insertion aperture, thereby defining a bridge between the opening and the head insertion aperture; separating the one or more lengths of cut non-woven fabric; folding each cut non-woven fabric through the head insertion aperture along a fold line parallel to the top edge, the fold line extending across the non-woven fabric thereby defining a front portion and a rear portion; and attaching the front portion to the rear portion along the side edges, from a location at the bottom and top edges, to a location short of the fold line, to thereby define two armholes.

It is to be understood that other aspects of the present disclosure will become readily apparent to those skilled in the art from the following detailed description, wherein various embodiments of the disclosure are shown and described by way of illustration. As will be realized, the disclosure is capable for other and different embodiments and its several details are capable of modification in various other respects, all without departing from the spirit and scope of the present disclosure. Accordingly, the drawings and detailed description are to be regarded as illustrative in nature and not as restrictive.

BRIEF DESCRIPTION OF THE DRAWINGS

A further, detailed, description of the disclosure, briefly described above, will follow by reference to the following drawings of specific embodiments of the disclosure. The drawings depict only typical embodiments of the disclosure and are therefore not to be considered limiting of its scope. In the drawings.

Figure 1A:
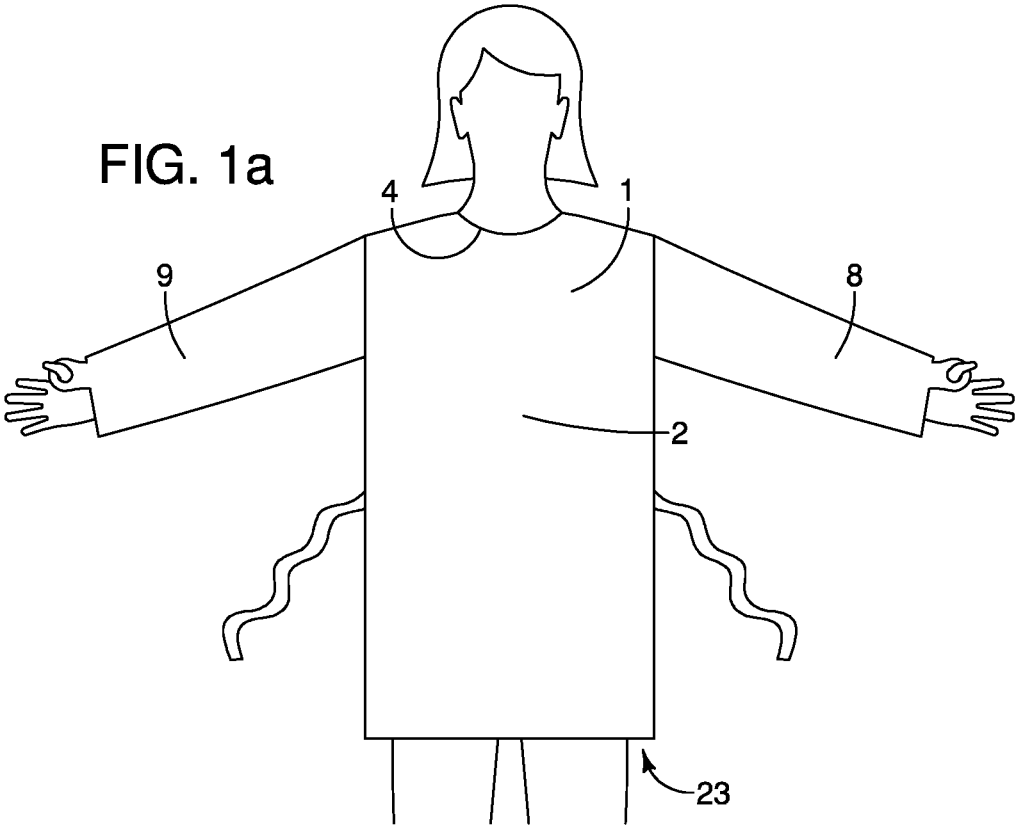
FIG. 1*a* is a front elevation view of a first embodiment of a gown of the present disclosure.
Figure 1B:
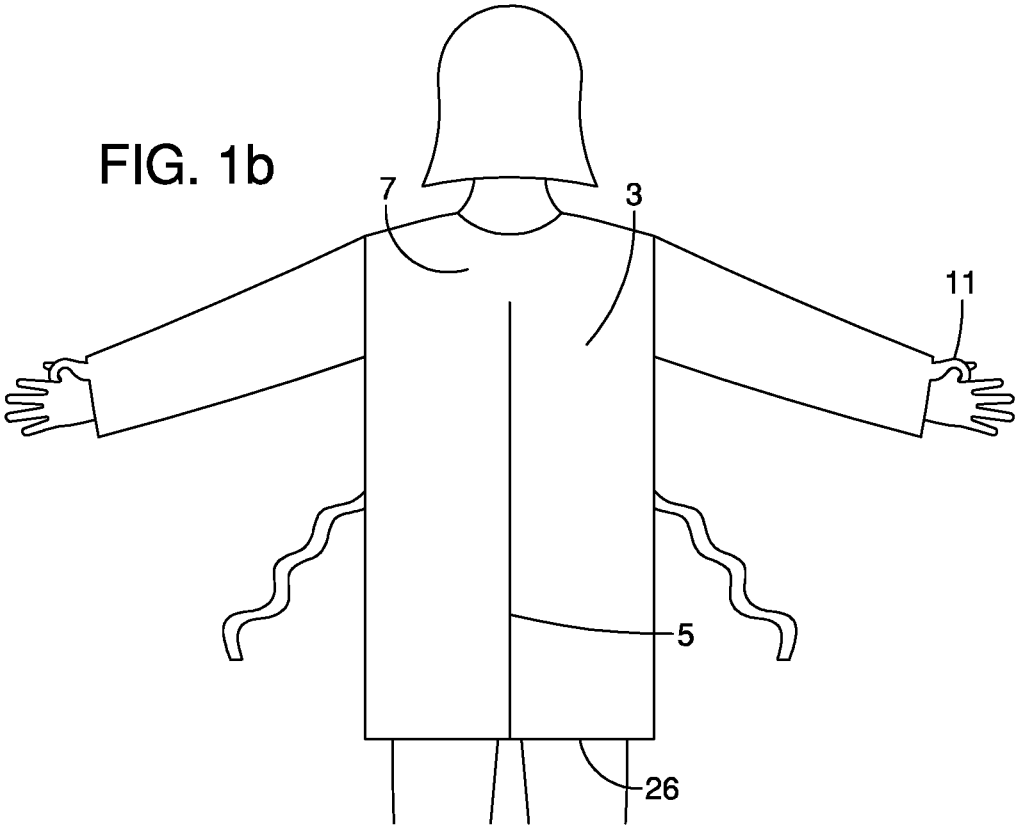
FIG. 1*b* is a rear elevation view of the gown of FIG. 1*a;*
Figure 2A:
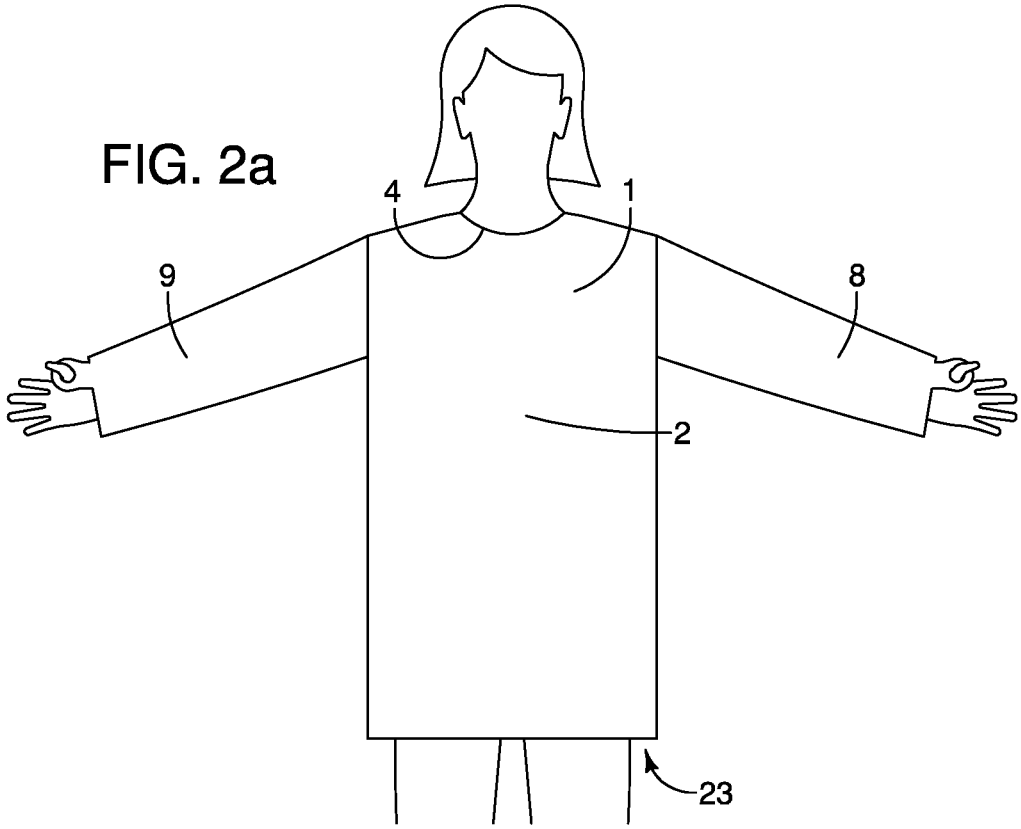
FIG. 2*a* is a front elevation view of a second embodiment of a gown of the present disclosure.
Figure 2B:
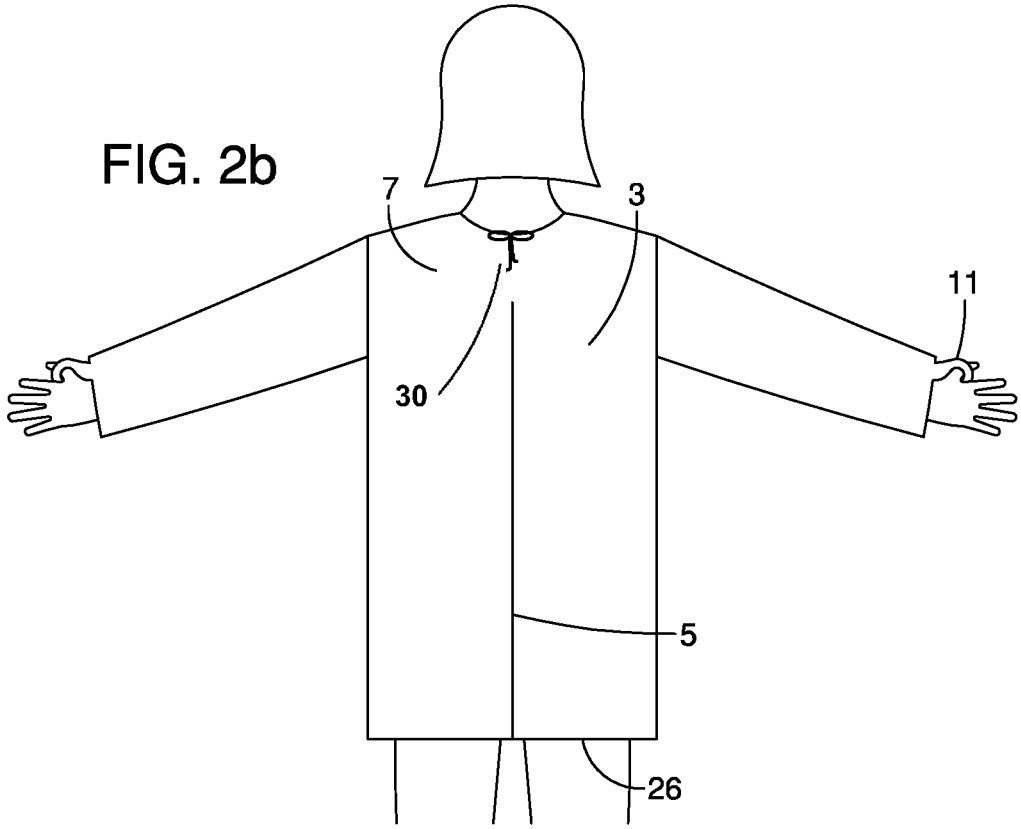
FIG. 2*b* is a rear elevation view of the gown of FIG. 2*a;*
Figure 3A:
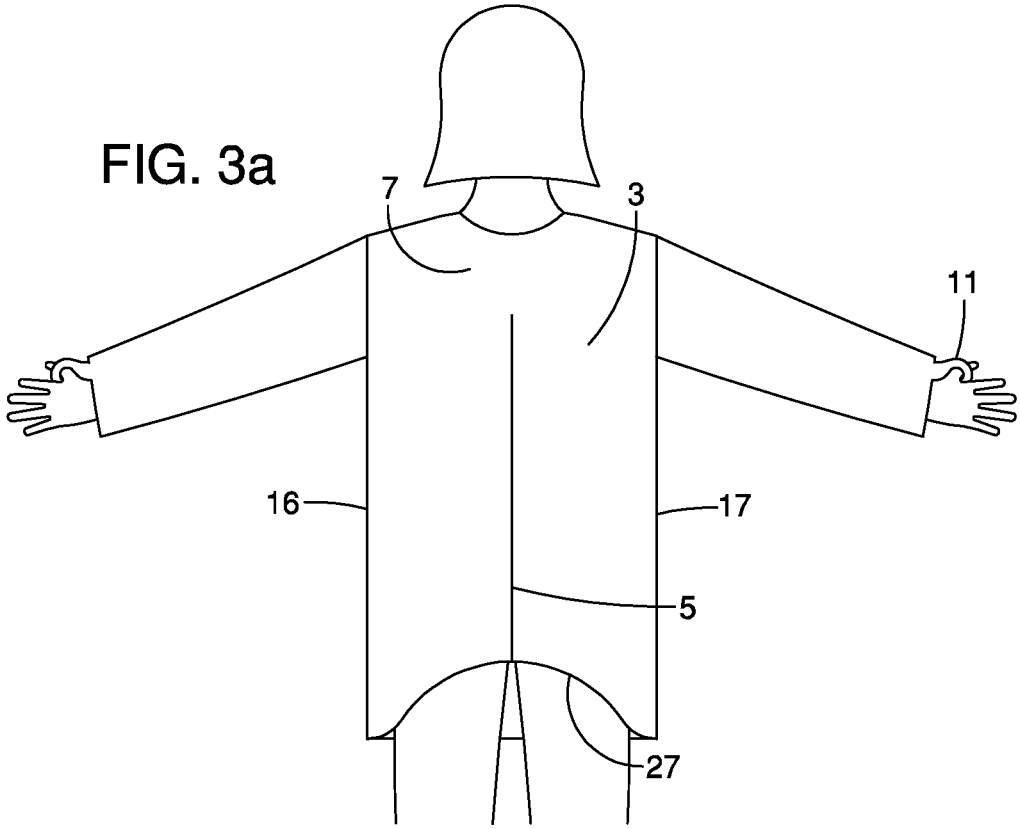
FIG. 3*a* is a rear elevation view of a third embodiment of a gown of the present disclosure.
Figure 3B:
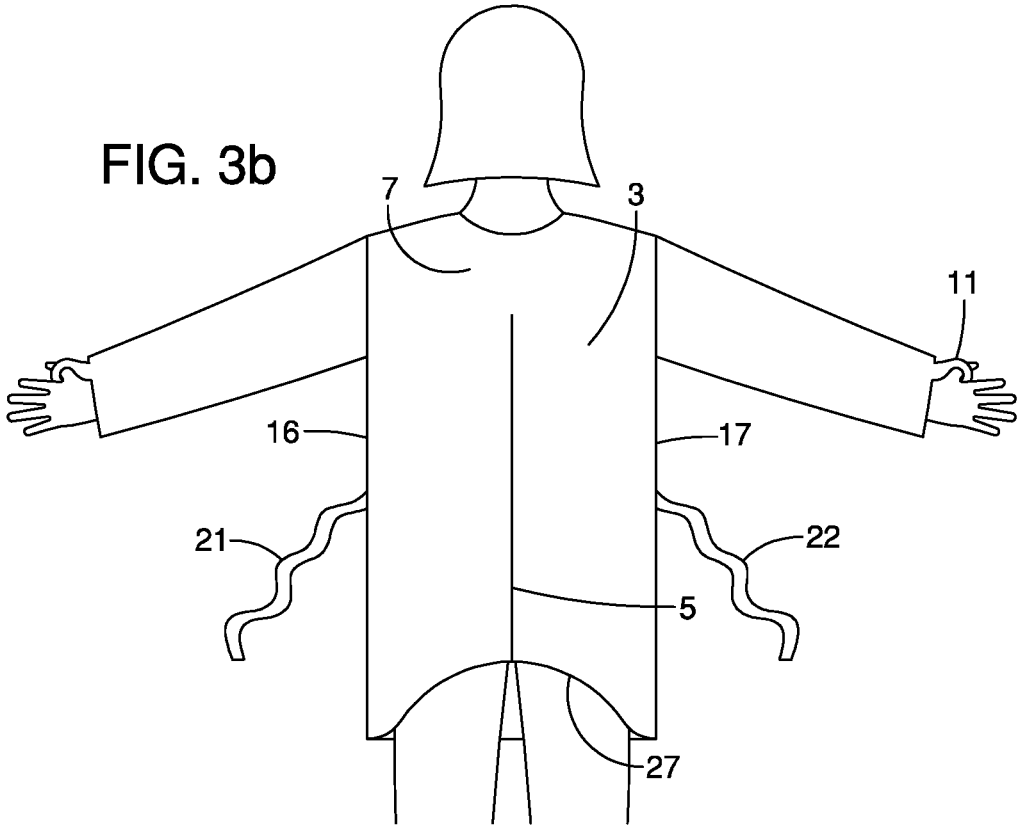
FIG. 3*b* is a rear elevation view of a fourth embodiment of a gown of the present disclosure

The drawing is not necessarily to scale and in some instances, proportions may have been exaggerated in order more clearly to depict certain features.

DETAILED DESCRIPTION OF VARIOUS EMBODIMENTS

The description that follows and the embodiments described therein are provided by way of illustration of an example, or examples, of particular embodiments of the principles of various aspects of the present disclosure. These examples are provided for the purposes of explanation, and not of limitation, of those principles and of the disclosure in its various aspects.

With reference to the figures the present disclosure relates to a medical gown (1) designed to overcome difficulties in removing medical gowns and complexities involved in manufacturing medical gowns.

While the present disclosure is described as a medical gown, this disclosure could be any number of gowns and is not necessarily confined to medical applications, and thus any references to a medical gown include garments, apparel, cover gowns, surgical gowns, surgical isolation gowns, front protection gowns or other gowns. More preferably, the garments related to the present disclosure are medical gowns such as surgical or isolation gowns.

While the present description may refer to such medical gowns and accessories and parts thereof, it would be understood by a person of skill in the art that the present disclosure can be applied to any number of other garments or fabric in general without departing from the scope of the disclosure.

With reference to the figures, the present disclosure provides for a medical gown (1) comprised of non-woven fabric. The medical gown (1) having a front portion (2) and a rear portion (3) with a head insertion aperture (4) and a lower opening (23), the lower opening (23) being defined by a lower edge 26 of the front portion (2) and a lower edge 27 of the rear portion (3).

In one embodiment, as illustrated in FIGS. 1*a*, 1*b*, 2*a*, 2*b*, 6*a*, 7*a*, 7*b*, 8*a*, 8*b* and 12*a* the length of the front portion (2) is equal to the length of the rear portion (3). In another embodiment, as illustrated in FIGS. 3*a*, 3*b* 4, 5, 6*b*, 9, 10, 11 and 12*b*, the length of the front portion (2) varies from the length of the rear portion (3) and is preferably greater in length than the rear portion (3).

In one embodiment, the head insertion aperture (4) is comprised of curved edges on the front portion (2) and the rear portion (3), as seen for example in FIGS. 1*a* to 6*b*. In another embodiment, the head insertion aperture (4) is comprised of at least somewhat straight edges on the front portion (2) and the rear portion (3), as seen for example in FIGS. 7*a* to 12*b*. In other embodiments, one example of which is illustrated in FIG. 2*b*, the head insertion aperture may be cinched tighter by cinching means (30), selected from of any one or more of ties, elastic, hook and loop, adhesive or other methods readily apparent to those skilled in the art.

The rear portion (3) of the medical gown (1) preferably comprises an opening (5). In one embodiment, the opening (5) comprises a slit. Preferably, the opening (5) is formed into the rear portion (3) starting from a lower rear edge (27) to a point short of the head insertion aperture (4). In a preferred embodiment, the opening (5) is a straight line along the rear portion (3) of the medical gown (1), running perpendicular to the lower rear edge (27) of the gown (1). More preferably, the opening (5) runs through the center of the rear portion (3) of the medical gown (1). The opening (5) ends directly below but separate from a lowest point that the head insertion aperture (4) extends into the rear portion (3) of the gown (1). The width of the opening (5) can range from greater than 0 cm to span the entire rear portion (3). Where the opening spans the rear portion (3), the rear portion (3) is defined as the bridge (7).

Between the opening (5) and the head insertion aperture (4) is a bridge (7). The bridge (7) can be defined as the section of non-woven fabric between the head insertion aperture (4) and the opening (5). The bridge (7) serves to tear and split the rear portion (3) when the front portion (2) is pulled away by the wearer. Preferably, the bridge (7) when measured from the head insertion aperture (4) to the opening (5) is between 2-10 cm in length and is of the same non-woven fabric that makes up the rest of the gown (1). Most preferably, the bridge (7) is 5 cm in length. The bridge (7) is a continuous piece with the rest of the rear portion (3). Preferably, the bridge (7) is comprised of the same type of fabric as the rear portion (3) of the gown.

The bridge (7) provides several functions. In one illustrative example, when the wearer pulls the medical gown (1) away from her torso, this causes the force of the pull motion to focus on the bridge (7) causing the non-woven fabric of the bridge (7) to tear from the opening (5) through the bridge (7) to the head insertion aperture (4). The width of the bridge (7) provides enough fabric to support the medical gown (1) when the user is donning and wearing the gown but is also thin enough to allow the user to easily tear and remove the gown. In addition, the width of the bridge (7) is designed to ensure that the bridge (7) tears predictably when force is applied to the medical gown (1).

More specifically, the bridge (7) free from any aids to tearing. While some examples of aids to tearing can include perforations or scores, aids to tearing for the purposes of the present specification also include notches or profiles formed at either end of opening (5) or formed in the insertion aperture (4), any neckline profiles in the insertion aperture (4) that aid in tearing, slits, or a section or length of thinner or weaker fabric in the bridge or elsewhere, amongst others. The present bridge (7) has no aids to tearing and furthermore, the bridge (7) together with opening (5) define the only mechanisms for tearing the gown (1).

The bridge (7) provides more coverage and privacy to the wearer than the prior art "v" neckline in the rear portion (3) otherwise would, allowing the wearer's back to be covered by the bridge (7).

Figure 13A:
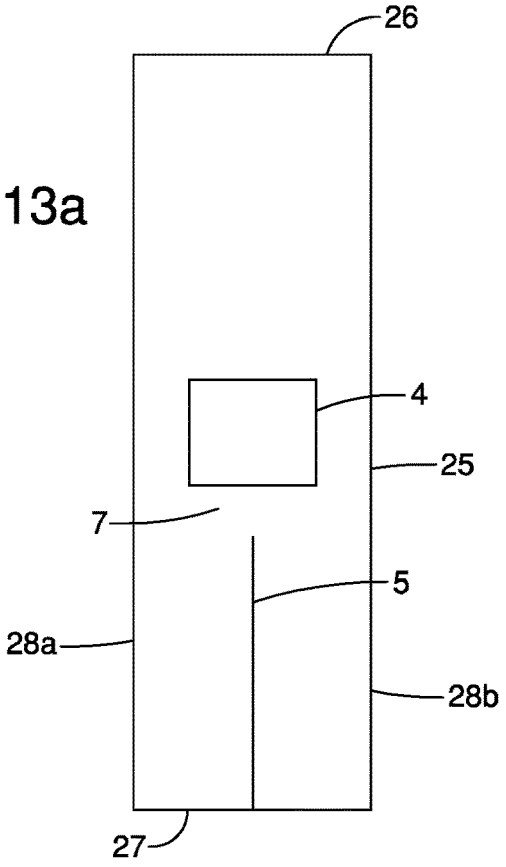
FIG. 13*a* is a plan view of a method of making a further embodiment of a gown of the present disclosure.
Figure 13B:
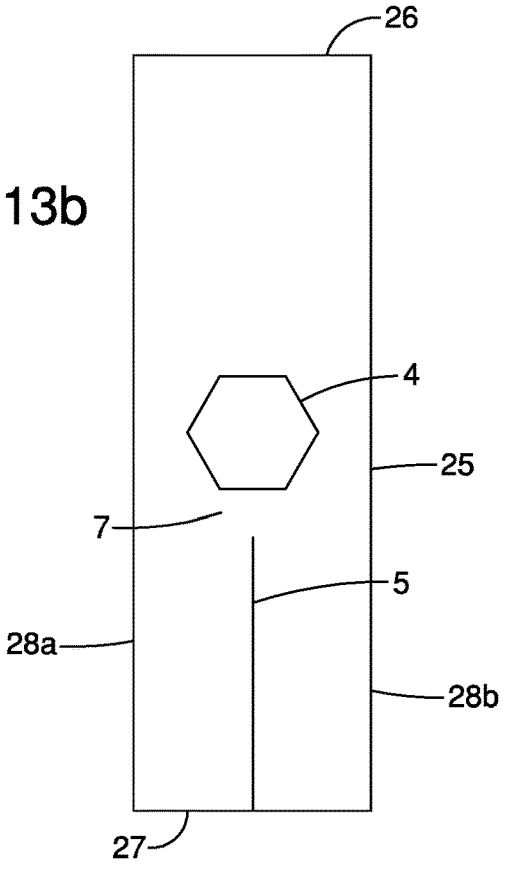
FIG. 13*b* is a plan view of a method of making yet a further embodiment of a gown of the present disclosure.

In one embodiment, as illustrated in FIGS. 1*a* through 6*b* the head insertion aperture (4) is curved, providing a round neckline into the medical gown (1) on the front portion (2) and the rear portion (3). In the embodiments shown in FIGS. 7*a* through 12*b*, the head insertion aperture (4) takes the form of a square or rectangle, preferably with rounded corners, thereby providing a square neckline. FIG. 13*a* illustrates a head insertion aperture (4) having a square or rectangular profile with orthogonal straight corners. FIG. 13*b* illustrate a head insertion aperture (4) having a hexagonal shape with strait corners, although it would be understood by a person of skill in the art that a hexagonal insertion aperture (4) with rounded corners is also possible. In a further preferred embodiment, the insertion aperture (4) is configured to ensure the gown rests on the neck and shoulders of the wearer evenly without "drooping" or "sagging" towards the front portion (2) exposing the chest of the wearer.

The medical gown (1) is configured to have a left sleeve (8) and a right sleeve (9) attached to the medical gown (1). The left sleeve (8) and right sleeve (9) can be attached to medical gown (1) in a variety of ways. In one embodiment, the left sleeve (8) and right sleeve (9) are adhesively attached to the medical gown (1). In another embodiment, the left sleeve (8) and right sleeve (9) are thermally or ultrasonically bonded to the medical gown (1). In one embodiment, the left sleeve (8) and right sleeve (9) are sewn to the medical gown. Optionally, the non-woven fabric of gown is cut with sleeves integral to the front portion (2) and/or the rear portion (3). In other options the left sleeve (8) and the right sleeve (9) and gown body may be comprised of different materials.

In one embodiment, the left sleeve (8) and the right sleeve (9) contain a retention member to retain each sleeve along the arm of the wearer. Optionally, the retention member contains elastic configured to engage the wrist of the wearer and hold the medical gown (1) close to the wrist of the wearer. In one option, the left sleeve (8) and the right sleeve (9) each terminate with a thumb loop (11) configured to engage the thumb of the wearer to hold each sleeve to the wrist of the wearer.

The thumb loops, where included, provide several functions. One illustrative function is that the thumb loops keep the sleeves (8)(9) pulled along the wearer's arms and prevent the sleeves (8)(9) from "riding up" and exposing the wearer's wrist or arm. Another illustrative function is that the thumb loops prevent twisting of the sleeves (8)(9) about the wearer's arm. Each thumb loop is configured, in one embodiment, to engage the saddle of a thumb of the wearer.

In other embodiments, the thumb loop (11) may be combined with a wrist elastic or a draw string and mechanism to maintain position around the wrist.

In another embodiment, one or more tie members (19) may be attached to the medical gown (1). The tie members (19) can be made from the same non-woven fabric as the medical gown (1), or from a different fabric or material. In one embodiment, the tie members include a first tie member (21) disposed on the left side (16) of the medical gown (1), and a second tie member (22) disposed on the right side (17) of the medical gown (1). Accordingly, one tie member (21) is disposed on one side of the opening (5), while the other tie member (22) is disposed on a second side of the opening (5).

In another embodiment, a single tie member (19) is attached to some point on the front portion (2) or the rear portion (3) of the gown, and is more preferably attached to a middle of the front portion (2) of the gown.

The tie member(s) (21)(22) can be attached to the medical gown (1) in a variety of ways. In one embodiment, the tie members (21)(22) are sewn to the medical gown (1). In another embodiment, the tie members (21)(22) are adhesively attached to the medical gown (1). In another embodiment, the tie members (21)(22) are thermally or ultrasonically bonded to the medical gown (1). Other attachment methods will be obvious to those of ordinary skill in the art. In the illustration of one embodiment, FIG. 3), the tie members (21)(22) are attached on a side medical gown (1). When the tie members (21)(22) are tied across the opening (5), the body of the medical gown (1) becomes cinched at the waist region of the wearer.

Optionally, the colour of the non-woven fabric is yellow however other colors may be preferred based on the end users' practices. Optionally, the non-woven fabric is impregnated with a material that changes colour when exposed to liquid or other contaminants or has other specialized functionality (e.g. chemical resistance, anti-microbial, or anti-viral properties etc.).

A variety of non-woven fabrics of differing strength that can be torn by a range of strengths of wearers, such as children, infirm or weakened wearers, elderly wearers may be selected for construction of the medical gown (1) in accordance with one embodiment.

Figure 4:
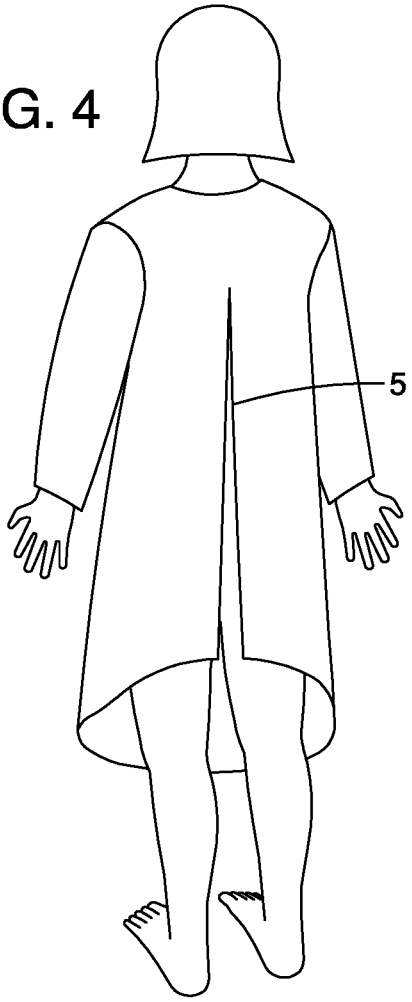
FIG. 4 is rear perspective view of a user wearing one embodiment of a gown of the present disclosure.
Figure 10:
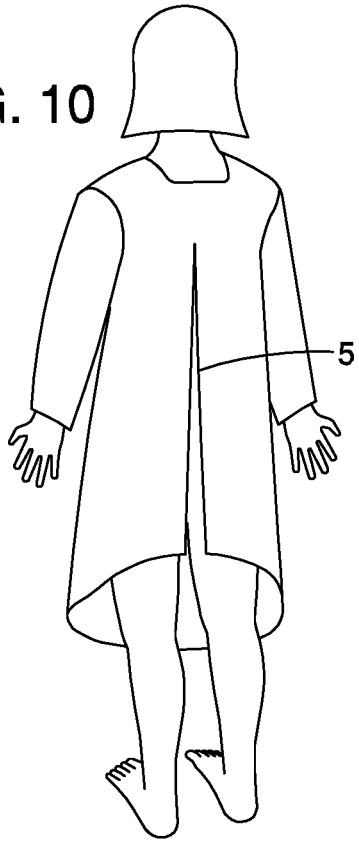
FIG. 10 is rear perspective view of a user wearing an embodiment of a gown of the present disclosure.

Turning now to FIGS. 4, 5, 10 and 11, illustrated therein is a method of wearing and removing a medical gown (1) in accordance with one or more embodiments of the disclosure. FIGS. 4 and 10 illustrate a wearer who has already donned the medical gown. In this illustrative embodiment, the medical gown (1) defines a head insertion aperture (4) between a front portion (2) and a rear portion (3). The rear portion (3) of the medical gown (1) contains an opening (5). The opening is cut into a lower rear portion (3) starting from the lower rear edge (27) to a point on the rear portion (3) below the head insertion aperture (4). In the preferred embodiment, the opening (5) is cut in a straight line. In one embodiment, the opening (5) runs perpendicular to the lower rear edge (27). Between the opening (5) and the head insertion aperture (4) is a bridge (7). The bridge (7) can be defined as the piece of non-woven fabric between the head insertion aperture (4) and the opening (5). The bridge (7) is configured to tear and split the rear portion (3) when the front portion (2) is pulled away by the wearer.

Figure 5:
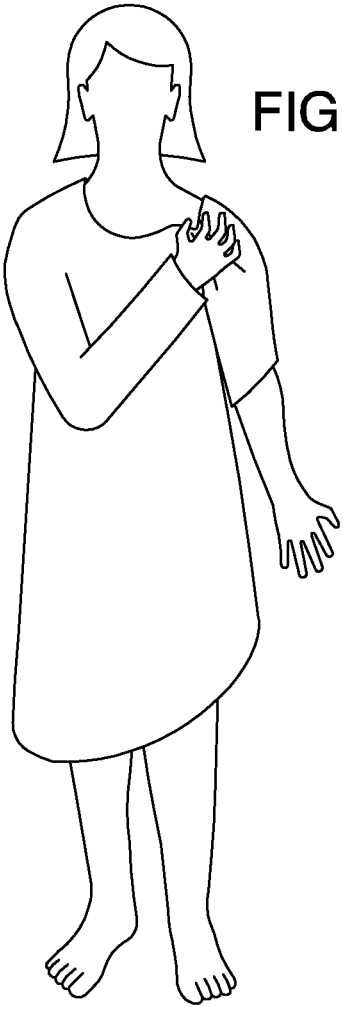
FIG. 5 is a front perspective view of a user removing the gown FIG. 4.
Figure 6A:
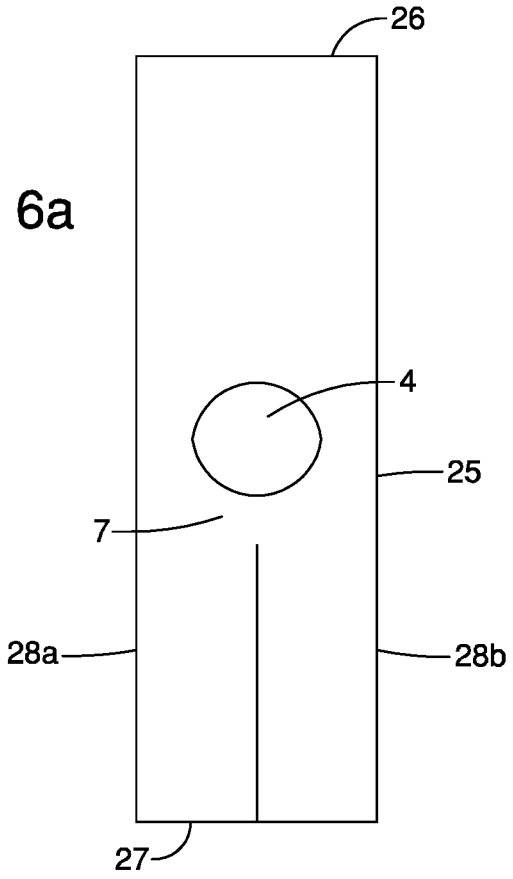
FIG. 6*a* is a plan view of a method of making one embodiment of a gown of the present disclosure.
Figure 6B:
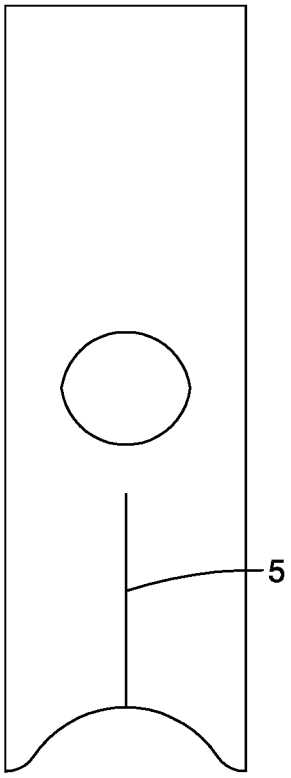
FIG. 6*b* is a plan view of a method of making another embodiment of a gown of the present disclosure.
Figure 7A:
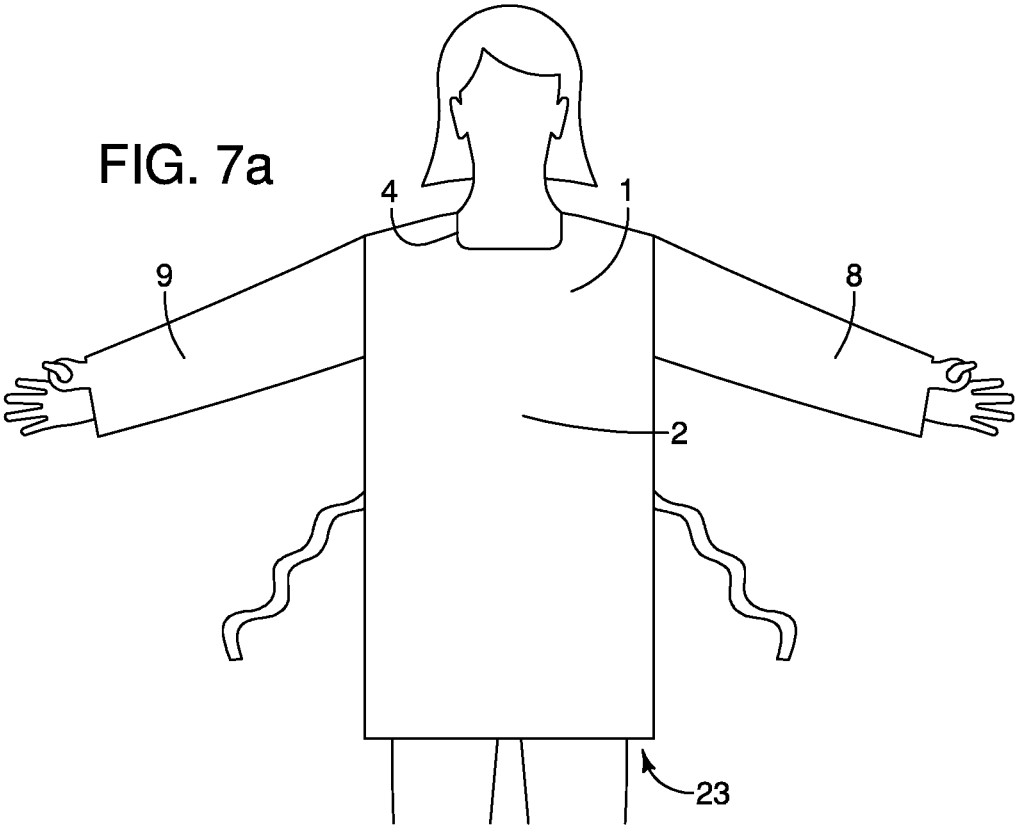
FIG. 7*a* is a front elevation view of a fifth embodiment of a gown of the present disclosure.
Figure 7B:
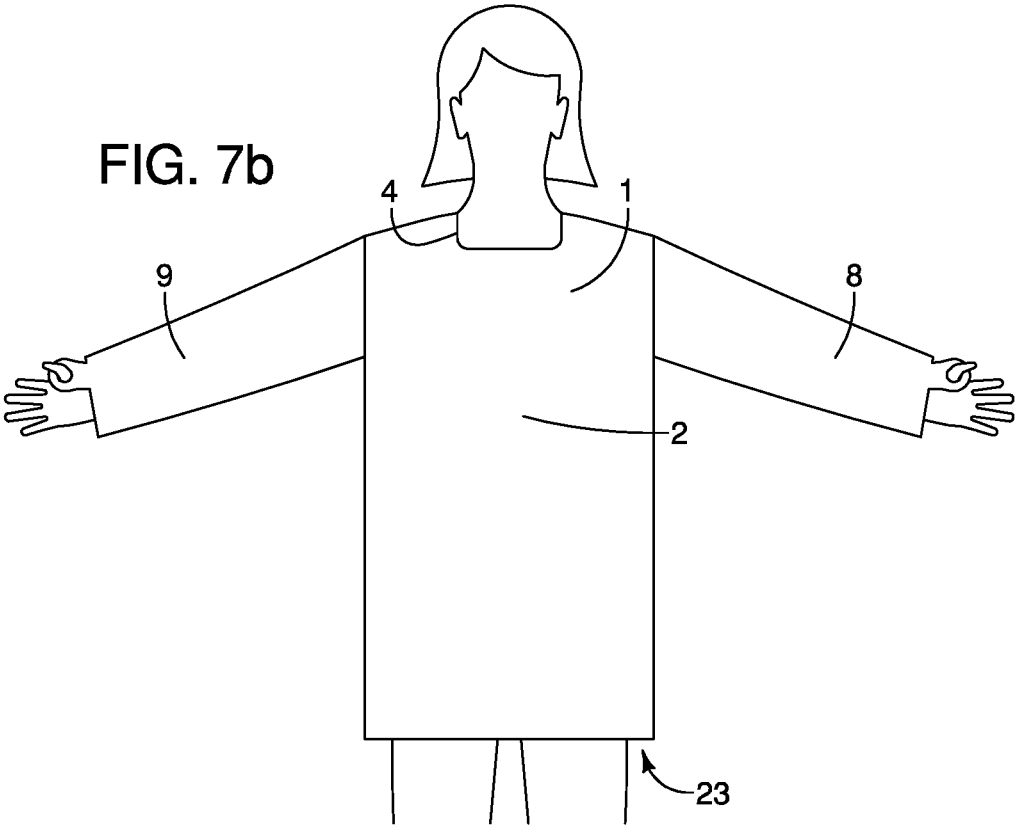
FIG. 7*b* is a front elevation view of a sixth embodiment of a gown of the present disclosure.
Figure 8A:
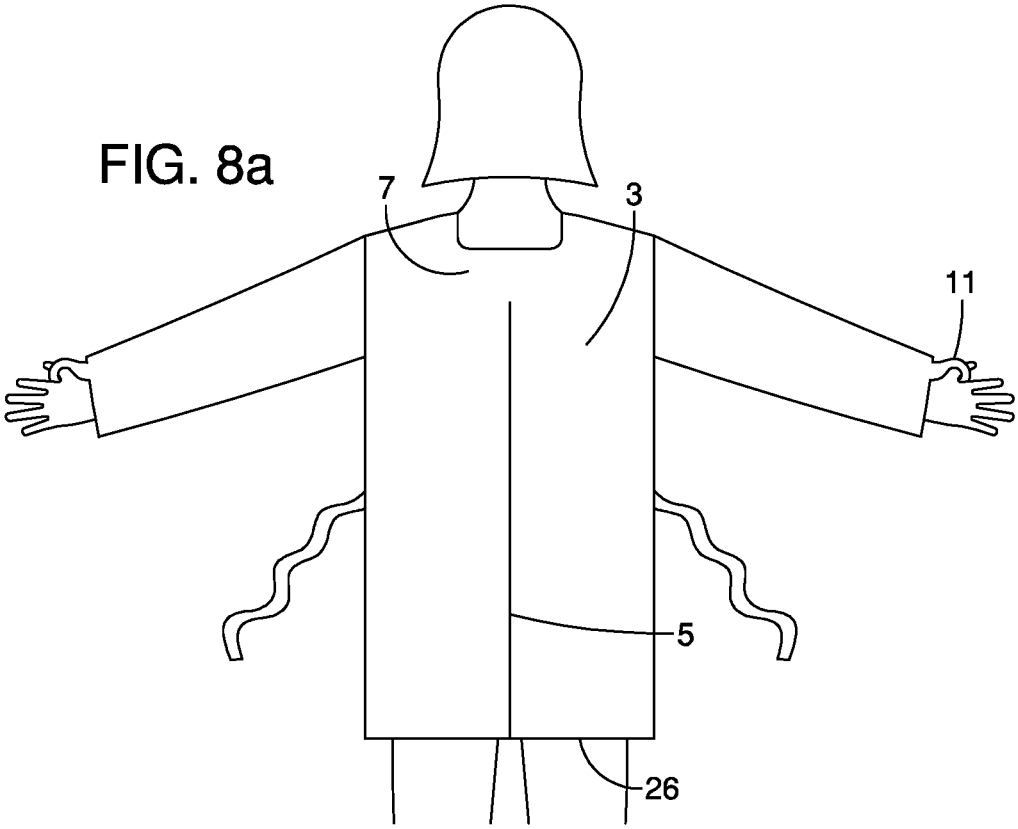
FIG. 8*a* is a rear elevation view of the gown of FIG. 7*a;*
Figure 8B:
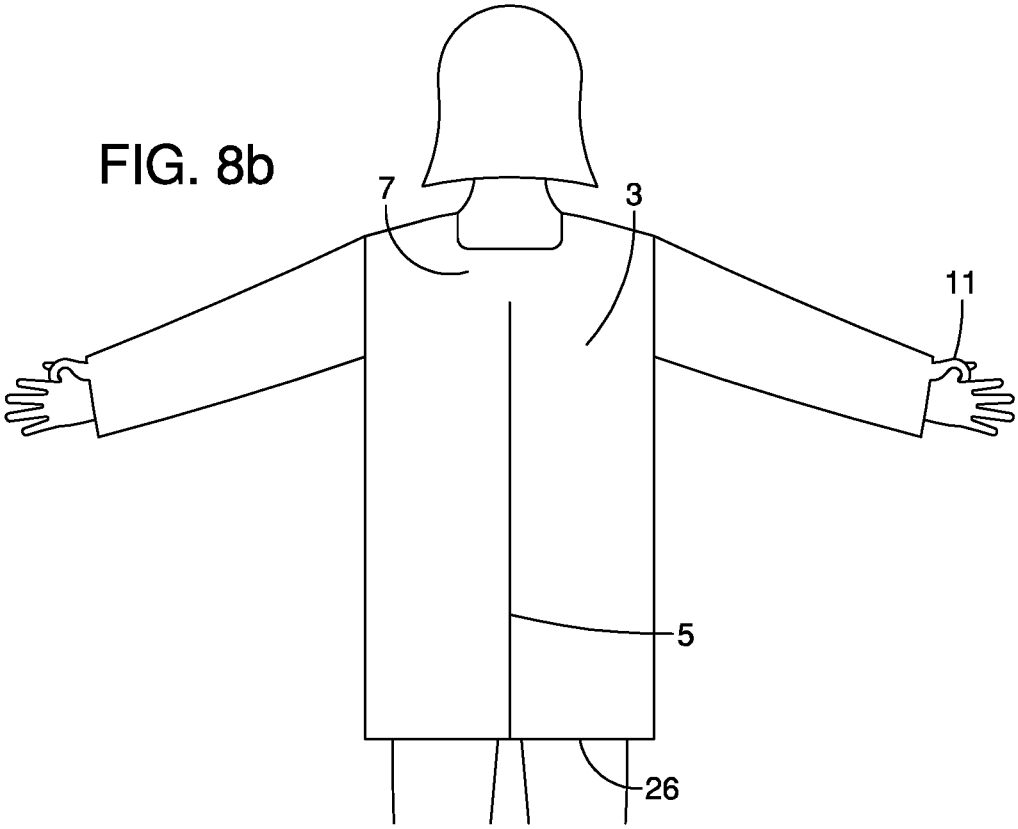
FIG. 8*b* is a rear elevation view of the gown of FIG. 8*a;*
Figure 9:
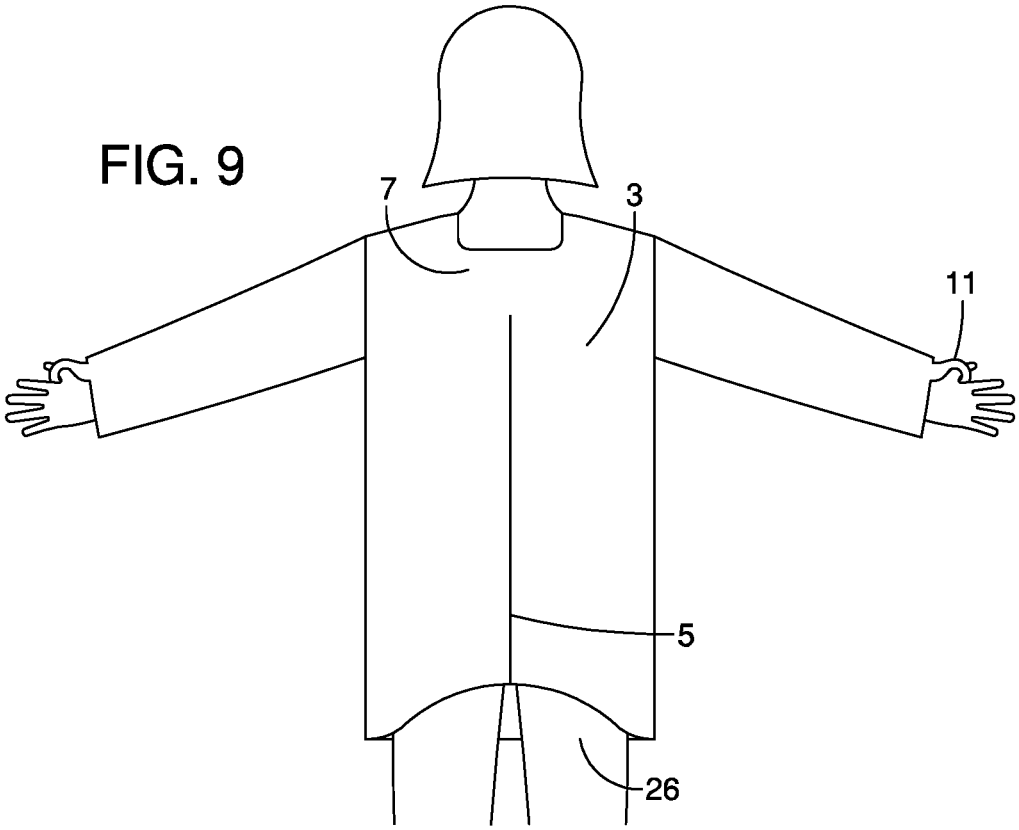
FIG. 9 is a rear elevation view of a seventh embodiment of a gown of the present disclosure.
Figure 11:
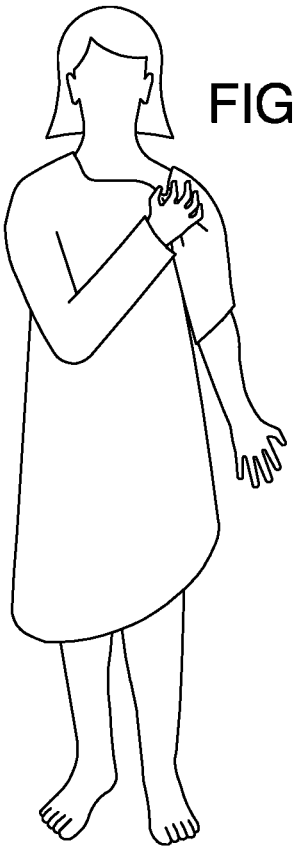
FIG. 11 is a front perspective view of a user removing the gown FIG. 10.
Figure 12A:
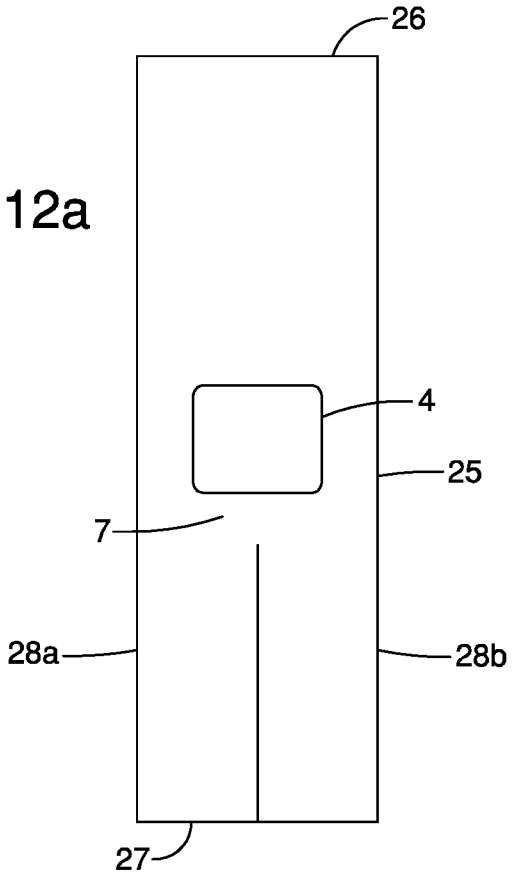
FIG. 12*a* is a plan view of a method of making one embodiment of a gown of the present disclosure.
Figure 12B:
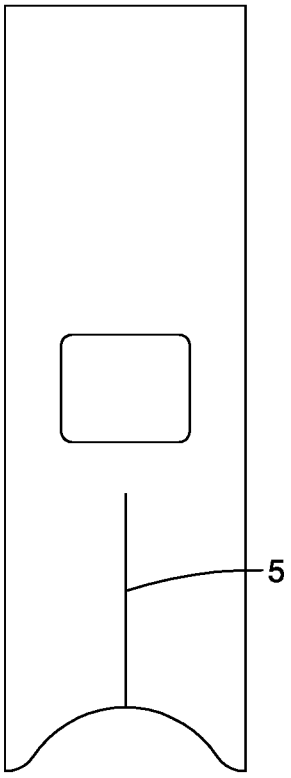
FIG. 12*b* is a plan view of a method of making another embodiment of a gown of the present disclosure.

Turning now to FIGS. 5 and 11, the wearer is illustrated removing the medical gown (1). Specifically, in this example she is using her right hand to grasp the front portion (2) of the medical gown (1). She then pulls medical gown (1) away from her torso. This causes the bridge (7) to tear, thereby splitting the rear portion (3) of the medical gown (1). This pulling action tears the bridge (7) and splits the bridge (7) between the head insertion aperture (4) and the opening (5). The wearer can now simply drop the medical gown (1) about her torso and step out of it or preferably, the user may roll the gown from the inside to avoid contact with the potentially contaminated outside surface of the gown and dispose of the rolled gown as waste. Where the tie members (21)/(22) are loosely tied, the pulling action can cause them to become untied, thereby facilitating simple removal of the medical gown (1) with a simple stroke.

Turning now to FIGS. 6*a*, 6*b*, 12*a* and 12*b* a method of making the medical gown (1) is provided. A roll of non-woven fabric is cut into lengths (25), each length (25) having a top edge corresponding to the lower front edge (26) of the medical gown (1) when made, a bottom edge corresponding to the lower rear edge (27) of the medical gown when made, and two opposing side edges (28(*a*)(*b*)). Optionally, multiple lengths (25) can be stacked one on top of the other, allowing for efficiencies in the method of making the medical gown (1) as more than one length (25) can be prepared simultaneously.

A cutting machine is used to cut the head insertion aperture (4) into the stack of lengths (25) of the non-woven fabric, the head insertion aperture (4) located approximately one-half the distance between the lower front edge (26) and the lower rear edge (27) and approximately one-half distance between the two opposing side edges (28(*a*)(*b*)). The opening (5) is also cut, parallel to the opposing side edges (28(*a*)(*b*)) and extending from the lower rear edge (27) to a point before the head insertion aperture (4); wherein the fabric between the opening (5) and the head insertion aperture (4) defines the bridge (7). Folding the medical gown (1) in half at the head insertion aperture (4) and joining the two opposing side edges (28(*a*)(*b*)) from the lower rear edge (27) and lower front edge (26) and extending partially to define sides of the medical gown (1), with unjoined parts of side edges (28(*a*)(*b*)) defining armholes. Joining can be done with the use of an ultrasonic weld. Optionally, the two opposing side edges (28(*a*)(*b*)) can be sewn together or joined using other methods familiar to those skilled in the art. The lower rear edge (27) and lower front edge (26) now define the lower opening (23) of the medical gown (1).

Optionally, sleeve pieces are then joined to the armholes of medical gown (1) though the use of an ultrasonic weld, sewing, adhesive, heat welds or other means well know in the art, along the opposing sides.

A cutting machine or other means may be used to punch a thump loop (11) in the sleeve pieces configured to engage the thumb of the wearer to hold each sleeve to the wrist of the wearer. Optionally, sleeve pieces are placed on a flat table forming layers before the cutting machine punches into the stack of sleeve pieces a thump loop, to allow for efficiencies in the method of making the thumb loop. Optionally, elastic is sown across the sleeve piece at a point between the first edge and the thumb loop.

In one embodiment, the tie members (21)(22) are then joined to the medical gown (1) through the use of an ultrasonic weld. Optionally, the tie members (21)(22) are sewn to the medical gown (1).

The previous description of the disclosed embodiments is provided to enable any person skilled in the art to make or use the present disclosure. Various modifications to those embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A gown comprising:

a. a front portion made of a non-woven fabric, a rear portion made of the non-woven fabric, a lower edge, and a head insertion aperture defined between the front portion and the rear portion;

b. an opening, the opening defined in the rear portion, said opening formed at the lower edge and extending towards the head insertion aperture, configured to assist a wearer in donning the gown; and c. a bridge made of the non-woven fabric and extending across the rear portion between the opening and head insertion aperture; the bridge having a width defined between the opening to the head insertion aperture, said width being sized to tear and split the bridge when the front portion is pulled away by the wearer, wherein the bridge is free from perforations, scores, slits, notches formed in the opening, profiles formed in the opening and notches formed in the head insertion aperture; and wherein the bridge when measured from the head insertion aperture to the opening is 10 cm in width.

2. The gown of claim 1, further comprises sleeves.

3. The gown of claim 2, wherein the sleeves terminate with a thumb loop configured to engage a base of a thumb of the wearer.

4. The gown of claim 2, wherein each of the sleeves contains an elastic retention member configured to engage a wrist of the wearer.

5. The gown of claim 1, further comprising one or more tie members.

6. The gown of claim 1, wherein a length of the front portion is equal to a length of the rear portion.

7. The gown of claim 1, wherein a neckline formed by the head insertion aperture is selected from a round neckline, a hexagonal neckline with straight corners, a hexagonal neckline with rounded corners, a square neckline with straight corners or a square neckline with rounded corners.

* * * * *